US008696431B2

(12) United States Patent
Safaei et al.

(10) Patent No.: US 8,696,431 B2
(45) Date of Patent: Apr. 15, 2014

(54) MOBILE PLAY INSTANT TICKET LOTTERY GAME

(75) Inventors: Aman Safaei, Alpharetta, GA (US); William J. Huntley, Cumming, GA (US)

(73) Assignee: Scientific Games International, Inc., Newark, DE (US)

( * ) Notice: Subject to any disclaimer, the term of this patent is extended or adjusted under 35 U.S.C. 154(b) by 1245 days.

(21) Appl. No.: 12/508,117

(22) Filed: Jul. 23, 2009

(65) Prior Publication Data

US 2010/0069136 A1 Mar. 18, 2010

Related U.S. Application Data

(60) Provisional application No. 61/097,630, filed on Sep. 17, 2008.

(51) Int. Cl.
*A63F 9/24* (2006.01)

(52) U.S. Cl.
USPC ..... 463/17

(58) Field of Classification Search
USPC ..... 463/17
See application file for complete search history.

(56) References Cited

U.S. PATENT DOCUMENTS

| | | | | |
|---|---|---|---|---|
| 4,582,324 | A * | 4/1986 | Koza et al. | 463/16 |
| 5,569,082 | A | 10/1996 | Kaye | |
| 5,709,603 | A * | 1/1998 | Kaye | 463/17 |
| 7,163,459 | B2 | 1/2007 | Tanskanen | |
| 2003/0181235 | A1 * | 9/2003 | Bennett, III | 463/17 |
| 2003/0190943 | A1 * | 10/2003 | Walker et al. | 463/17 |
| 2004/0235550 | A1 | 11/2004 | McNally et al. | |
| 2005/0192078 | A1 * | 9/2005 | Jawaharlal | 463/17 |
| 2008/0081686 | A1 | 4/2008 | Irwin, Jr. et al. | |

FOREIGN PATENT DOCUMENTS

| | | |
|---|---|---|
| FR | 2 800 492 | 5/2001 |
| FR | 2 881 006 | 7/2006 |
| WO | WO 2008/038254 | 4/2008 |

OTHER PUBLICATIONS

PCT Search Report and Written Opinion, December 11, 2009.

* cited by examiner

*Primary Examiner* — Corbett B Coburn
(74) *Attorney, Agent, or Firm* — Dority & Manning, P.A.

(57) ABSTRACT

A method and system for implementing an instant win lottery game includes receiving a player's wager and selection of a game at a point-of-sale (POS) lottery location. The player receives a lottery ticket corresponding to the selected game, with the lottery ticket including a unique identification code that dictates the outcome of the game. The player accesses the lottery authority system via a wireless internet enabled mobile device to display and play an instant win game to reveal the outcome of the lottery ticket.

21 Claims, 6 Drawing Sheets

MOBILE PLAY INSTANT TICKET LOTTERY GAME

PRIORITY CLAIM

The present application claims priority to U.S. Provisional Application Ser. No. 61/097,630, filed Sep. 17, 2008.

FIELD OF THE INVENTION

The present invention generally relates to a lottery game and system, and more particularly to a unique instant ticket lottery game.

BACKGROUND

Scratch-off or instant win lottery tickets have enjoyed immense popularity in the lottery industry for decades. These games offer distinct advantages to the lottery authorities, and are attractive to a broad spectrum of players. However, in order to sustain the public's interest in the instant games, new and different types of games and innovations are being constantly developed by the lottery industry.

One method of increasing interest in instant win tickets is to produce higher payout prizes. However, most lottery jurisdictions regulate payout percentages by charter and therefore cannot utilize higher payout tickets as a means of increasing sales.

Another method to increase instant win ticket sales is to expand distribution of the tickets to new locations, such as super market checkout lanes, restaurants, and so forth. However, the logistics, accountability, and security issues associated with placing instant lottery tickets in higher traffic locations are problematic and often impractical.

Still another method is to create a more "exciting" instant ticket by expanding the limited amount of play area (a.k.a. scratch-off area) to create an extended play experience. These larger tickets permit larger or multiple play areas (e.g., bingo games). However, the physical size of a ticket can be increased only by a limited amount, and players often perceive that the playing time does not reflect the higher cost of larger tickets.

Recently, electronic game cards have been introduced by the lottery industry. While these devices are in essence the functional equivalent of an instant ticket, they are perceived by the public as adding significant entertainment value to the concept of an instant lottery game. However, these electronic game cards are relatively expensive to manufacture, and the added expense creates decreased payouts and lower prize levels for the consumer, thereby possibly impacting long-term sales. Additionally, the electronic game card presents various logistical challenges. For example, in some game cards, prize payouts are programmed by placement of wire bonding during manufacturing. This method of programming creates numerous challenges in ensuring that each card is affixed with an encrypted lottery barcode that agrees with the card's prize outcome. This problem is especially burdensome when considering that the electronic game cards must be assigned a pseudo-sequential serial number to be compatible with lottery validation systems. Examples of electronic game devices are described in U.S. Patent Application Publication Nos. 2004/0235550 and 2008/0081686.

Interactive lottery games are also known in the art wherein players interact with the gaming authority over a communications network (such as the Internet or a telephone network). For example, games have been proposed whereby a player may purchase a ticket directly from the gaming authority via the Internet and select certain criteria related to the game from a set of different options, such as the numbers the player wishes to play, or the time the ticket is to be activated. Direct interactive games, however, also have certain drawbacks. For example, such games are not popular with lottery ticket retailers because the retailer is unnecessary to initiate or play the game and is thus bypassed by the player. This can significantly reduce customer traffic in the retailer's establishment and, thus, diminish the incentive for the retailer to act as a lottery vendor. Interactive games also suffer the disadvantage of not having an effective method to distribute or award prizes through the retailer. Also, such games often require the player to purchase the ticket with a credit card, which is not legal in all venues.

The present invention relates to a system and method for a lottery game that merges the benefits of an instant win ticket system with the entertainment value of a portable electronic device.

SUMMARY

Objects and advantages of the invention will be set forth in the following description, or may be obvious from the description, or may be learned through practice of the invention. It is intended that the invention include modifications and variations to the system and method embodiments described herein.

A method and associated system are provided for implementing an instant win lottery game that incorporates unique features of scratch-off lottery tickets, yet is played on an electronic mobile device. To play the game, players may purchase a lottery ticket at a point-of-sale (POS) lottery location, which may be any establishment or location that sells conventional lottery tickets, particularly scratch-off tickets. Such locations typically have a lottery terminal that is networked with a lottery authority central computer for various control, accountability, and administrative functions. Desirably, the method and system of the present invention may provide a plurality of different instant win games (i.e., different themes) and, upon placing their wager, the player also selects the type of instant win game they desire to play.

The lottery tickets have any manner of indicia, graphics, and the like, that identify and advertise the particular instant win game. Each ticket includes a unique identification code that dictates whether or not the lottery ticket is a winning ticket (as revealed in a subsequent associated instant game). The code may be any manner or configuration of numbers, letters, or other visual marks that can be input by the player using an electronic mobile device.

The identification code provided on the lottery ticket may be visible or covered by an opaque scratch-off layer such that the player must remove the scratch-off layer prior to initiating play of the instant win game, which can provide additional entertainment value to the player.

At a subsequent time chosen by the player (which may be limited by an expiration time established by the lottery authority), the player accesses the lottery authority system via a wireless Internet enabled mobile device. Such device may be, for example, a mobile phone, a personal data assistant (PDA), or any other type of handheld personal computing device. As explained herein, certain embodiments may require that the player's mobile device have game software loaded thereon to enable the device to play the instant win games. The software may be loaded at any convenient time, even before purchasing a lottery ticket. If the software is required and was not previously loaded, the player may be provided instructions for downloading the game software at the time of accessing the lottery authority system.

It should be understood that the "lottery authority system" includes any one or combination of entities that provide and administer or support the lottery game, and may include, for example, a state or other jurisdictional authority, a game provider, a wireless platform provider, a mobile network, and so forth.

The player may access the lottery authority system by conventional means. For example, the player may be provided with an URL address to access the lottery authority system via their mobile device, a PC, or other Internet enabled device. In one embodiment wherein game software is necessary to play the games on a mobile device, the player may access the lottery authority system with the URL address via a PC, download the game software to the PC, and subsequently transfer the game software to their mobile device by any conventional means. Alternatively, the game software may be downloaded directly to the mobile device.

In still another alternative embodiment, the player is provided with a short code mobile network number and an SMS text message to be sent to the number to access the lottery system, wherein the mobile device is then directly linked to the lottery system for downloading and playing the game, or for downloading game software (if needed) and subsequent play of the game.

Depending on the type and complexity of the instant win game, it may not be necessary that operating software be loaded and stored on the player's mobile device prior to play of the game. The game may be simply downloaded to player's device with the necessary game software, which may remain resident in permanent memory on the device (such as with a Java script game), or may be resident for a limited time in non-permanent memory.

The player transmits the lottery ticket identification code to the lottery authority system via their mobile device for verification of the lottery ticket. This verification process may include any manner of scrutiny or verification desired by the lottery system authority. A first verification step may include, for example, determining whether the lottery ticket has been previously redeemed, or presented for play, and so forth. Upon acceptable verification, the instant win game is downloaded to the player's mobile device.

The outcome of the instant win game is predetermined by the ticket identification code, and is not influenced by the player's subsequent play of the game on their mobile device. In other words, the code dictates the status of the ticket. If the code identifies the ticket as a winning ticket (and the respective prize amount), then the system downloads a game to the player that is a winning game (i.e., that satisfies the conditions dictated by the identification code), and the player cannot change the outcome of the game or the prize award. The downloaded game in essence "reveals" to the player the status of the ticket originally purchased at the POS location.

In a particular embodiment, the downloaded game displays a simulated scratch-off play area on the player's mobile device, with the player removing a simulated scratch-off layer by manipulation of the mobile device to reveal underlying indicia that indicates whether the lottery ticket is a winner. For example, the player may use any combination of keys on the mobile device to simulate removing the scratch-off layer. The visual display depicts the layer being removed, and displays the underlying indicia.

At completion of the game, the game may generate a message on the mobile device indicating that the game is a winner, and the prize amount. This message may be displayed immediately after completion of the game, or at a later time. The player may also be instructed on how to claim the prize award. In a unique embodiment, the player redeems the original lottery ticket to collect the prize award, for example at a lottery location such as any one of the POS locations. In addition, at game completion, the mobile device may send a message indicating to the lottery authority system that a game associated with the particular ticket identification code has been played. However, it may be desired that the mobile device not communicate with the lottery authority system after the initial verification and game download.

The lottery authority may maintain a library of downloadable instant win games, and retrieve and download one of the stored games that satisfies the criteria dictated by the ticket identification code. A plurality of the games may be stored that satisfy the same ticket criteria, but present the results to the player in a different visual manner, game format, and so forth. For example, ten different games may be stored for a particular game theme that satisfy a $100 winning ticket criteria, and any one of the ten games may be downloaded when a corresponding ticket identification code is entered by the player.

Because the outcome of the game is predetermined by the ticket identification code, the player may be presented with the option to present the lottery ticket at the POS location, wherein a lottery terminal may be used to reveal whether the ticket is a winning ticket without the player actually playing the instant win game on a mobile device.

In a particular version of a simulated scratch-off instant win game played on the player's mobile device, the underlying indicia has a predetermined static location in the play area that does not change during play of the game. With this type of game, the player simply removes the scratch-off layer to reveal the underlying indicia, which is located in a pattern or location in the play area that constitutes a winning or loosing game according to the game rules. For example, a tic-tac-toe game may involve simply removing the scratch-off layer from a game board to reveal whether three X's or O's are disposed in a winning configuration. With this type of game, the software necessary for play of the game simply be downloaded to player's device with the game.

In a particularly unique embodiment, the simulated scratch-off play area displayed on the mobile device has defined individual scratch-off positions, with the player removing the simulated scratch-off layer from a designated number of the positions that is less than all of the scratch-off positions to reveal underlying indicia that indicates whether the lottery ticket is a winner. The location of the indicia is not static or predetermined, but is automatically determined as the game is played in response to the player's selection of scratch-off positions so as to generate the predetermined game result regardless of the scratch-off positions selected by the player. In other words, although the outcome of the game is predetermined, the location of the indicia is not, but varies as a function of the player's selection. This particular type of game provides the player with an extended play perception, and sense of skill or chance necessary for a winning event.

In a version of this type of game, the scratch-off positions are configured in an interconnected pattern, such as a grid, continuous line, or other configuration wherein the positions are interconnected, and a winning event in the game results from a defined number or pattern of indicia aligning in adjacent positions selected by the player. In yet another version, the scratch-off positions may be discrete or isolated, and a winning event in the game results from a defined number or type of indicia being revealed in the scratch-off positions selected by the player.

DETAILED DESCRIPTION

Figure 1:
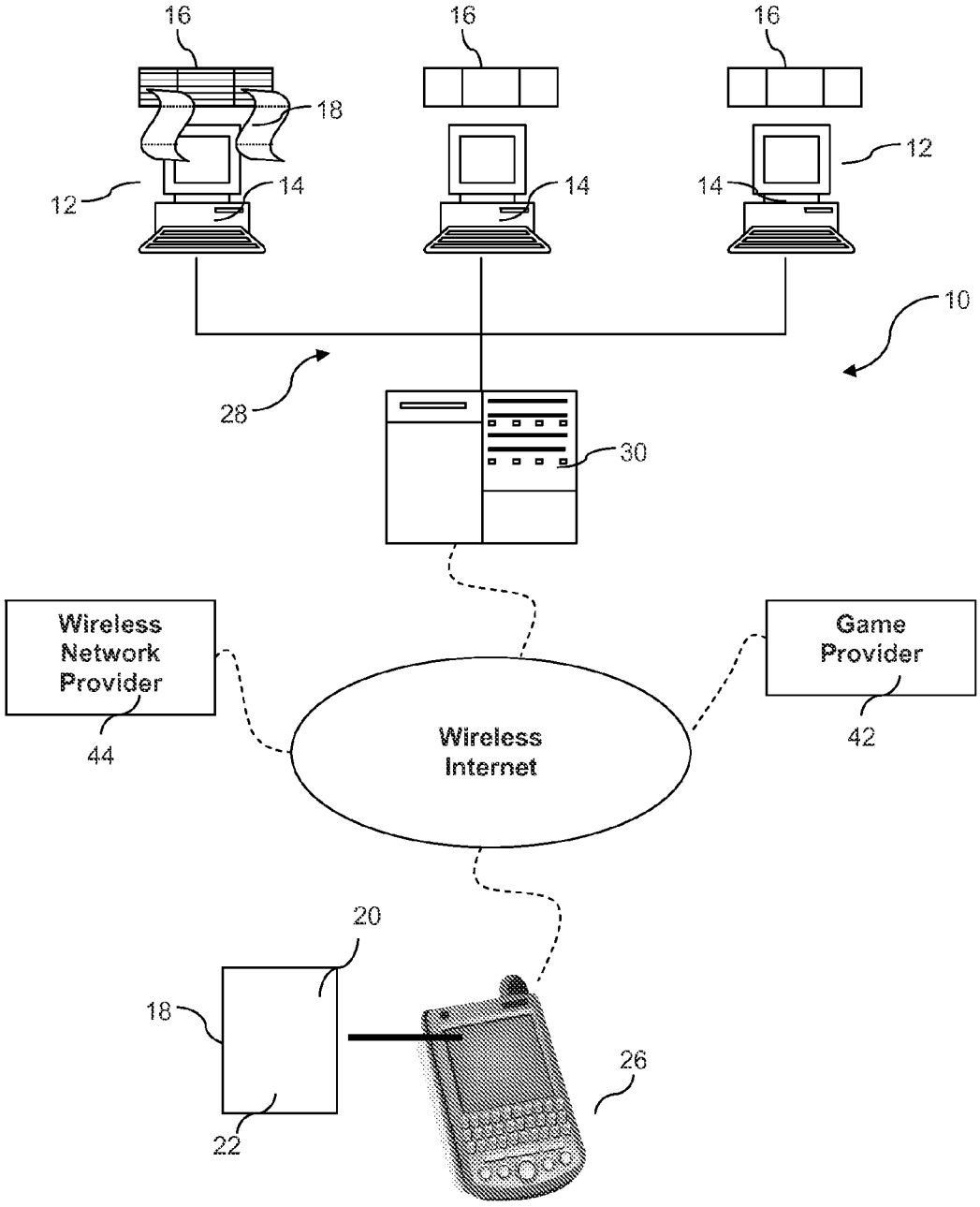
FIG. 1 is a diagram view of a system and methodology in accordance with certain embodiments of the invention.

Reference will now be made in detail to certain embodiments of the system and methodology in accordance with aspects of the invention, examples of which are illustrated in the drawings. Each embodiment is provided by way of explanation of the invention, and is not meant as a limitation of the invention. For example, features illustrated and described as part of one embodiment may be used with another embodiment to yield still a further embodiment. It is intended that the present invention include these and other modifications and variations as come within the scope of the appended claims and their equivalents.

FIG. 1 is a diagrammatic view of a system 10 that may be configured to practice aspects of the method in accordance with the invention. A plurality of point-of-sale (POS) locations 12 are provided for players to purchase lottery game tickets 18. The POS locations 12 may be any establishment or location that sells any manner of conventional lottery tickets, particularly scratch-off tickets. Such locations may be, for example, convenience stores, filling stations, dedicated lottery establishments, and virtually any manner of retail establishment. These locations 12 typically include a lottery terminal 14 that is networked with a lottery authority system, represented by the server 30 in FIG. 1, for various control, accountability, and administrative functions. The POS locations 12 may include any manner or configuration of ticket dispenser 16 for dispensing lottery tickets 18 used to play the present game. The ticket dispenser 16 may be configured in accordance with any manner of conventional scratch-off ticket dispenser. It should be readily appreciated that the manner or configuration of the hardware, software, and dispensers at the POS locations 12 is not a limiting factor to the method and system of the invention.

It should also be readily appreciated that the present system and method are not limited to play of any particular type of instant win game. The system and method are compatible with virtually any type of instant win game, particularly a simulated scratch-off lottery game having a desired game theme.

Figure 4A:
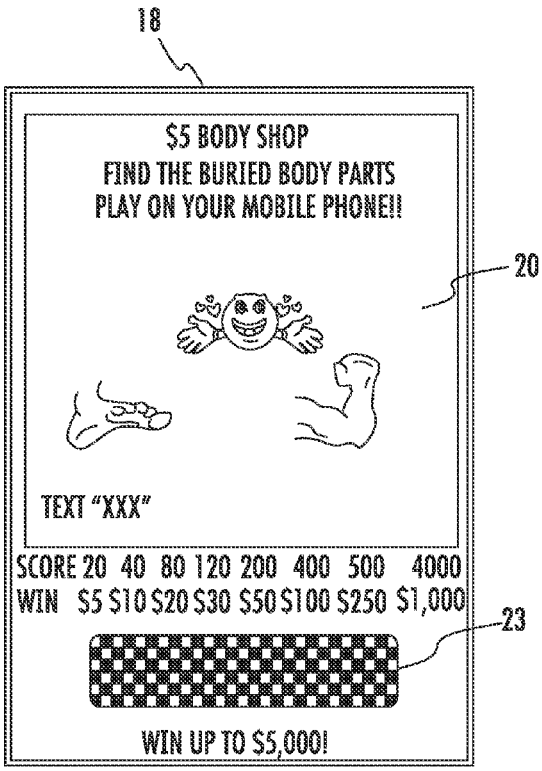
FIGS. 4A and 4B are perspective views of a lottery game ticket in accordance with an alternative embodiment of an instant win game.
Figure 4B:
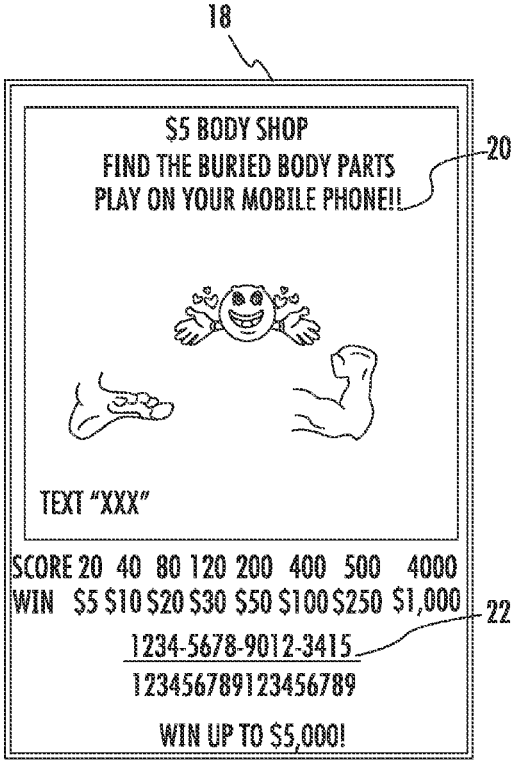

Referring in particular to FIGS. 3A, 3B, 4A, and 4B, exemplary lottery game tickets 18 include any manner of indicia, graphics, and the like 20, that identify and advertise the particular game. For example, in FIGS. 3A and 3B, the indicia 20 on the front side of the ticket 18 relates to a particular game named "Make-A-Snake." In addition the ticket may provide instructions, rules, prizes, and the like, to the player, for example on the backside of the ticket 18. FIGS. 4A and 4B illustrate a lottery game ticket 18 having a "Body shop", as graphically and visually depicted by indicia 20. Each of the tickets 18 includes a unique identification code 22. This code 22 may contain any manner of information desired by the lottery authority, and dictates whether or not the lottery ticket 18 is a winning ticket. The code 22 may be any manner or configuration of numbers, letters, or other visual marks that can be readily input by a player using an electronic mobile device, as described in greater detail below. In the embodiment illustrated in FIGS. 3A, 3B, 4A, and 4B, the identification code 22 is covered by a scratch-off layer 23. Upon purchasing the ticket 18, the player removes the scratch-off layer 23 to reveal the identification code 22. In alternative embodiments, the code 22 may be displayed on the ticket 18 without being hidden by a scratch-off layer.

As described in greater detail below, a player has the opportunity to play an instant win game on an electronic mobile device for each ticket 18 purchased. Conventional electronic mobile devices 26 are illustrated, for example, in FIG. 1, FIG. 3C and FIG. 4C. It should be appreciated that the present method and system are not limited to any particular type of electronic mobile device 26, and such devices include, for example, a mobile phone, a personal data assistant (PDA), or any other type of handheld personal computing device. These devices are wireless internet enabled, as widely recognized by consumers and those skilled in the art.

In yet another embodiment, the game may be played on a non-mobile internet enabled device, such as a PC, a car or other vehicle computer, and the like.

Referring again to FIG. 1, the lottery game ticket 18, and particularly the identification code 22, is used by a player in conjunction with an electronic mobile device 26 to initiate play of the instant win game via the internet. Any number of entities, providers, and the like, may be networked to support and administer the game. Thus, it should be understood that the "system" may include any one or combination of such entities, including state or other jurisdictional authorities, a game provider 42, a wireless platform provider, a mobile network provider 44, and so forth. Any combination of hardware and software configurations may be readily devised by those skilled in the art for this purpose. For example, many commercial systems are readily available for conducting gambling and casino-style games via the internet from a PC or PDA. Such systems may be readily configured to support the present system and method.

Figure 2A:
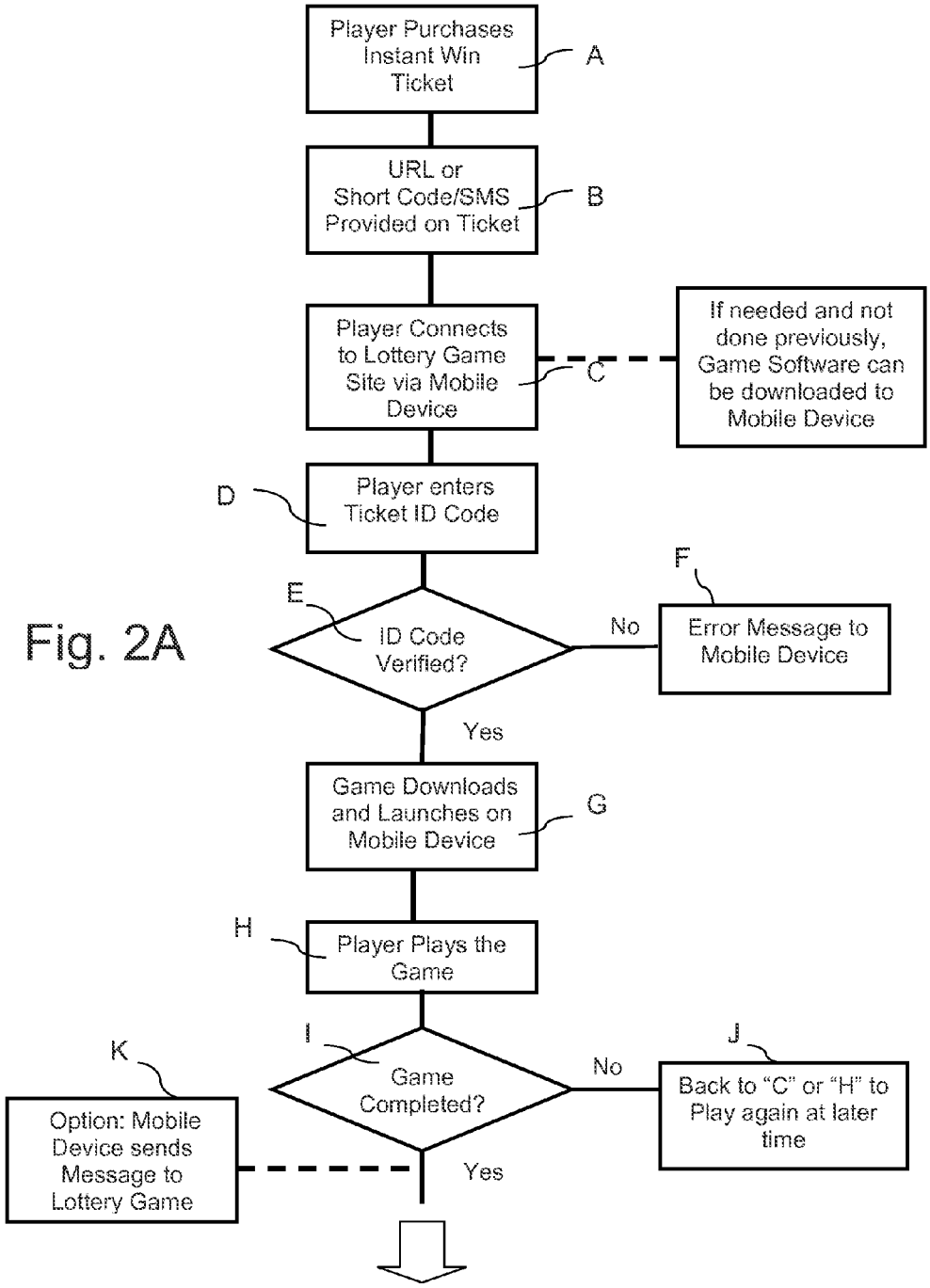
FIGS. 2A and 2B are flow chart diagrams illustrating conceptual aspects of the method and system of exemplary embodiments.
Figure 2B:
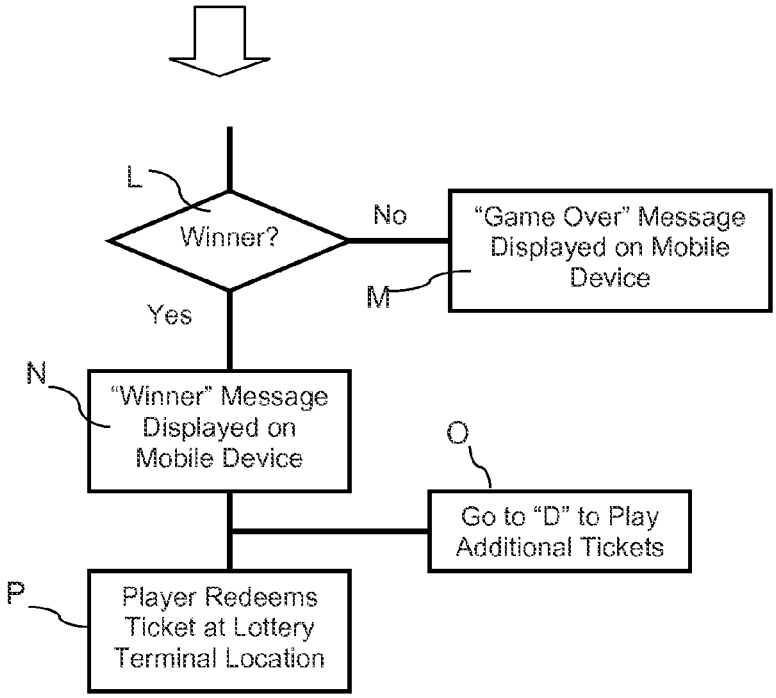

FIGS. 2A and 2B illustrate an embodiment of the methodology for playing the instant win game. At step A, the player purchases their instant win ticket at any convenient POS location 12 (FIG. 1). At step B, the player is provided with means to accesses the lottery authority system at some time subsequent to (or even prior to) purchase of the ticket. This access means may be provided directly on the lottery ticket. For example, the player may be provided with a URL address to access the lottery authority system via their mobile device, a PC, or other internet enabled device, in step C. In still another embodiment, the player is provided with a short code mobile network number and an SMS text message to be sent to the number in order to access the lottery system site, wherein the mobile device is then directly linked to the lottery system in step C.

Although not necessary for all embodiments, certain embodiments may require that the player's mobile device be configured with permanent (i.e., stored) game software to be able to play certain games, particularly more sophisticated games. This software may be loaded onto the mobile device by any conventional means. For example, the player may access the lottery authority system with a URL address via a PC, to download game software to the PC, which may then be subsequently transferred to the player's mobile device. In an alternative embodiment, the game software may be downloaded directly to the mobile device at the time of playing the game, or at some time prior to playing the game. The game software may be resident on the mobile device from a first or initial play of a game. At step C, the player may be queried upon accessing the lottery game site as to whether the game software has been downloaded, or the presence or absence of the game software may be automatically detected and automatically downloaded. If previously loaded, or upon loading, the software may launch automatically upon accessing the lottery authority site.

At step D, the player transmits the lottery ticket identification code provided on the previously purchased ticket 18 via their mobile device for verification of the lottery ticket by the lottery authority at step E. This verification process may include any manner of scrutiny or verification desired by the lottery authority. For example, a first verification step may include determining whether the lottery ticket has been previously redeemed, or presented for play, and whether or not play was completed. If the ticket fails some aspect of the verification process at step E, an error message may be sent to the player via the mobile device in step F. This error message may inform the player as to the reason for rejecting the ticket, and may provide the player with additional instructions with respect to the invalid ticket.

Upon proper verification of the ticket at step E, the instant win game downloads and launches on the player's mobile device at step G. The game may include any manner of instructions for the player to actively play the game via the keys 25 (FIGS. 4C and 3B) on their mobile device 26. The player then plays the instant win game on their mobile device at step H.

It should be appreciated that the steps of downloading the game software, verifying the ticket identification code, and downloading the game may take place in an order other than that depicted in FIGS. 2A and 2B. For example, the steps may take place substantially simultaneously upon the player accessing the lottery authority site and entering the ticket identification code.

For any number of reasons, the player may opt not to finish the game. In this event, the player may have the option at step J to restart the game from the beginning at a subsequent time. For example, the player may start the game again at step C, as depicted in FIG. 2A. In another embodiment, the game may remain resident in the player's mobile device, wherein the player simply restarts the game at step H.

If the player completes the game, then it may be desired that the mobile device re-connects with the lottery game server at step K to notify the server that the game downloaded for the unique ticket identification code was completed. However, it may also be desired that, once the game has been downloaded to the mobile device, no further communication between the mobile device and the server is necessary.

If the game is a winner (as dictated by the ticket identification code) at step L, then at completion of the game, a "winner" message may be displayed on the mobile device at step N. This message may provide the player with any manner of information related to the winning game play, for example the amount won, instructions on how to redeem the prize award, and so forth. If the game is a loser, then a "game over" or other similar message may be displayed on the mobile device at step M.

If the player purchased multiple lottery tickets and desires to play the tickets in succession, he may play other ticket at step O by entering the ID code for another ticket and starting the process at step D.

In a particularly unique embodiment, in the event of a winning game play, the player redeems the original lottery ticket 18 to collect the prize award. For example, at step P the player may simply present the original lottery game ticket 18 at any one of the POS locations 12 to collect the prize award. At the POS locations, the ticket 18 may be scanned at the POS terminal 14, or the ticket identification code may be otherwise manually input into the lottery system terminal 14, to verify that the ticket presented for redemption is a valid game ticket. This embodiment may be preferred in that the vendor receives additional foot traffic related to the lottery game.

As discussed above, the outcome of the instant win game played on the mobile device 26 is predetermined by the ticket identification code 22, and is not influenced by the player's subsequent play of the game. In other words, the code dictates the status of the ticket (i.e. winner or loser). If the identification code identifies the ticket as a winning ticket, then the lottery authority system downloads a game to the player's mobile device that satisfies the "win" conditions dictated by the identification code. The player cannot change the outcome of the game with subsequent play of the game on their mobile device. Thus, play of the game on the mobile device essentially "reveals" to the player the status of the ticket 18 originally purchased at the POS location 12. The instant win game played on the mobile device does, however, offer the player significant entertainment value and the perception of a game of skill and/or chance.

Figure 3A:
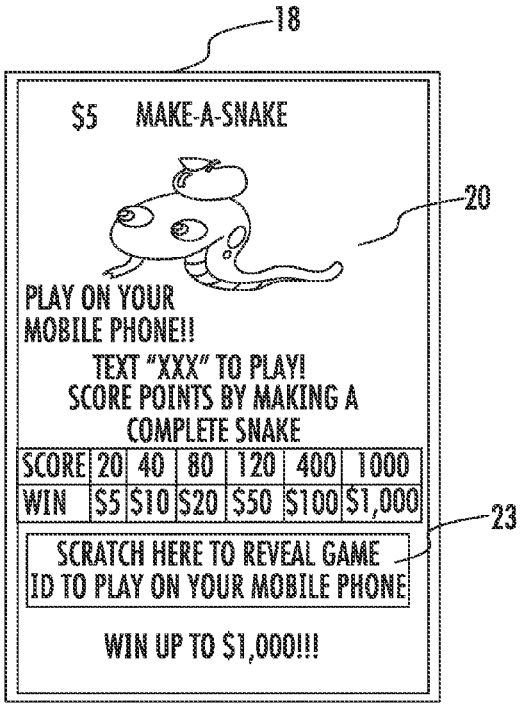
FIGS. 3A and 3B are perspective views of an exemplary lottery ticket.
Figure 3B:
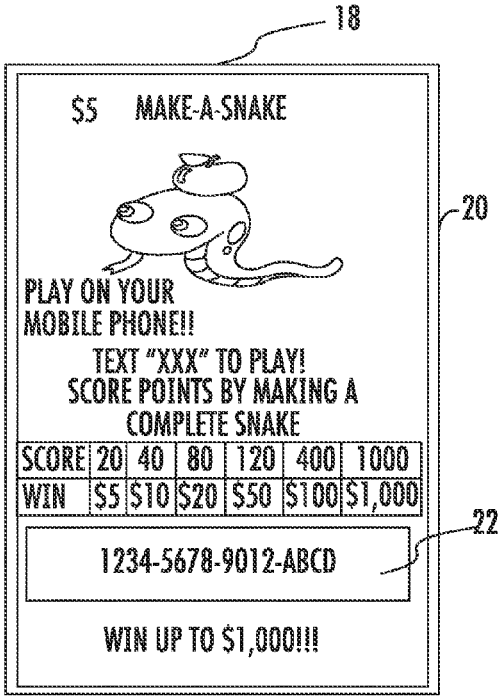
Figure 3C:
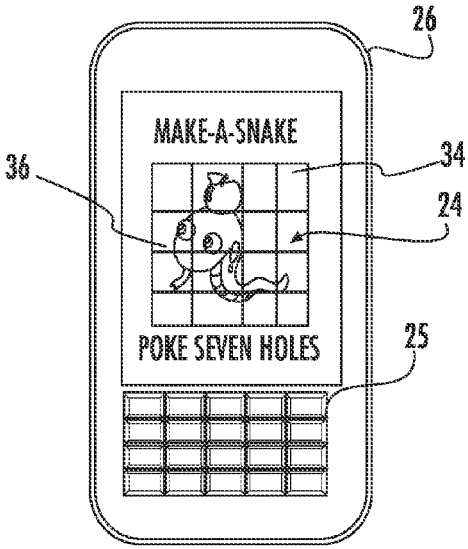
FIG. 3C is a perspective view of an electronic mobile device configured for play of an instant win game in accordance with certain embodiments of the invention.
Figure 4C:
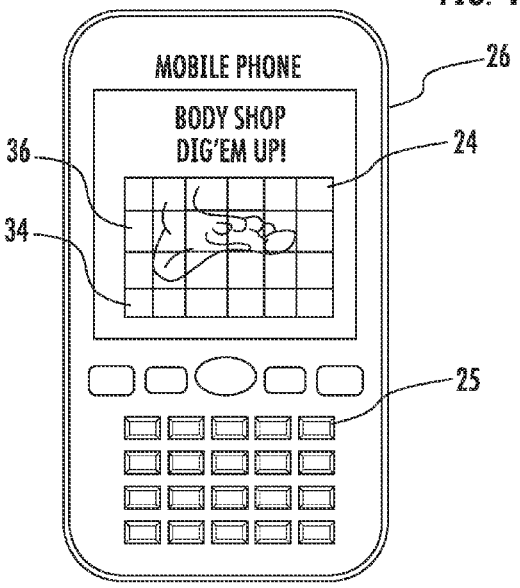
FIG. 4C is a perspective view of an electronic mobile device configured for play of the game illustrated in FIGS. 4A and 4B.
Figure 5A:
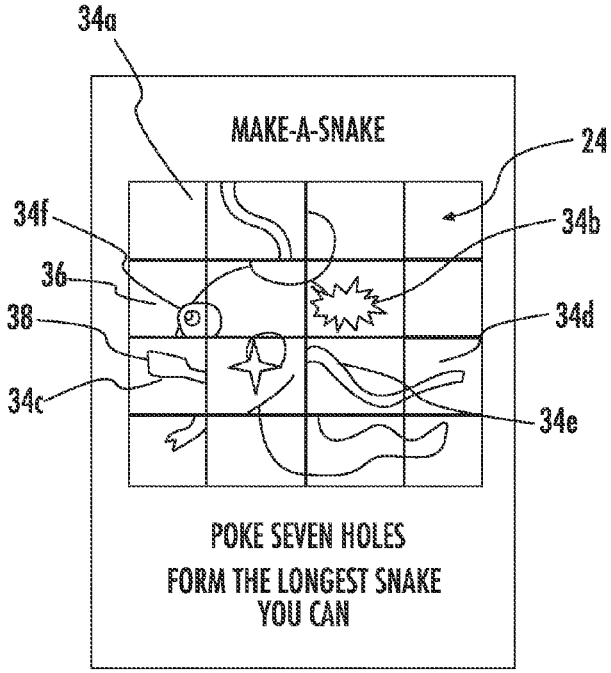
FIGS. 5A and 5B are perspective views of the play area of an electronic mobile device configured for play of alternative embodiments of an instant win game in accordance with aspects of the invention.
Figure 5B:
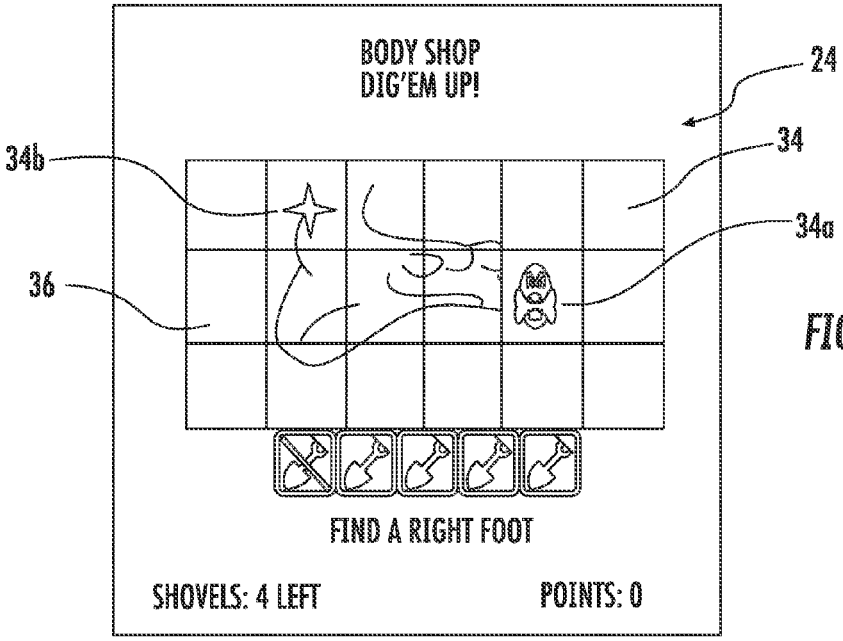

As mentioned, it should be readily appreciated that any manner of instant win game may be implemented by the system and method of the present invention. Referring to FIGS. 5A and 5B, in particular embodiments, the downloaded game displays a simulated scratch-off play area 24 on the player's mobile device 26. To play the game, the player simulates removing a scratch-off layer 36 from the play area 24 via manipulation of the mobile device keys 25 (FIGS. 3C and 4C). The visual display on the mobile device 26 reveals underlying indicia 38 that depicts the results of the game.

In one embodiment, the underlying indicia 38 has a predetermined static location in the play area 24 that does not change or vary as a function of how or when the player removes the simulated scratch-off layer 36. With this type of game, the player simply removes the simulated scratch-off layer 36 to reveal the underlying indicia 38, which is presented in a predetermined pattern, location, or other configuration that reflects whether the game is a winner or loser according to the game rules. For example, the game play area 24 may reveal a tic-tac-toe game board, or other grid, that requires the player to simply remove the simulated scratch-off layer 36 to reveal the pattern of underlying indicia. The manner or order in which the player removes the indicia has no bearing on the game.

In an alternative embodiment, the player is presented with the perception that they are controlling the outcome of the game by the manner in which the simulated scratch-off layer 36 is removed. For example, referring to FIG. 5A, the play area 24 may include a number of discrete individual scratch-off positions 34 arranged in a grid, or any other pattern according to the rules of the game. The player removes the simulated scratch-off layer 36 from a designated number of the positions 34 that is less than all of the scratch-off positions 34 to reveal the underlying indicia 38 in the limited number of positions 34. Whether or not the underlying indicia 38 meets the "win" criteria of the game rules determines whether or not the game is a winner. With this type of game, the location of the underlying indicia 38 within the play area 24 is not static or predetermined, but is automatically determined by the game software as the game is played in response to the player's selection of particular scratch-off positions 34 so as to generate the predetermined game result regardless of the scratch-off positions actually selected by the player. In other words, referring to the "Snake" game theme in FIG. 5A, the player may be presented with a predetermined number of "hole pokes" (i.e., attempts) that is less than the total number of positions 34 within the game play area 24. In order to win the game, the player's hole pokes must reveal underlying indicia 38 that completes a certain length snake. The outcome of the game is predetermined and, thus, the game software must position the underlying indicia 38 so as to form a complete snake regardless of the order or pattern of the positions 34 selected by the player.

In this type of game, the scratch-off positions 34 are configured in an interconnected pattern, such as the grid illustrated in FIG. 5A, continuous line, or other configuration wherein the positions are interconnected, and a winning event in the game results from a defined number or pattern of underlying indicia 38 aligning in adjacent positions selected by the player. For example, again referring to FIG. 5A, the game is predetermined such that eventually a complete snake formed from a predetermined number of the positions will be revealed by the underlying indicia 38 (the snake is formed between the positions 34*c* and 34*d*). In this particular game, the player has seven hole pokes. The player's first selection may have been position 34*a* wherein the underlying indicia reveals a tail segment of a snake oriented in a generally horizontal direction. The player's next selection logically may have been position 34*b*. However, the predetermined outcome of this particular game requires a snake made from four positions 34, and thus a complete snake formed from three positions (including position 34*a*) is not generated. In this case, the software may generate a "rock" symbol (i.e., a miss) in position 34*b*. The player has five pokes remaining, and the software configures the underlying indicia so that the complete "large" snake will be revealed in the remaining positions selected by the player. For example, the player's next selection may be position 34*c*, and the software may automatically generate the snake's head in this position. This will prompt the player to select an adjacent position, or at least a position in the same row, such as position 34*d*. In this case, the software will automatically generate the tail section of the snake in position 34*d*.

In the unlikely event that the player selects a nonsensical or illogical position, such as position 34*f*, the game software will generate a "try again" or other symbol indicating to the player that this is not a valid selection. In other words, the software will force the outcome of the game by only allowing the player to select positions that will result in the predetermined outcome of the game. For example, in FIG. 5A, the player eventually selected the positions adjacent to position 34*c* and 34*d*, and the player's last selection indicated by the "star" is position 34*e*. This is the player's last poke, and will complete the "large" snake. Thus, the player wins the prize amount for a snake formed from four positions 34. It is important to understand that regardless of the order or pattern in which the player selects the positions 34, the software automatically configures the underlying indicia to satisfy the predetermined outcome of the game.

In the "Body Shop" game version illustrated in FIG. 5B, the scratch-off positions 34 may be discrete or isolated, with the outcome of the game being independent of an interconnected relationship of the underlying indicia between adjacent positions 34. For example, a winning event may be determined from a defined number or type of indicia being revealed in the selected scratch-off positions that number less than the total number of positions 34. For example, in the game illustrated in FIG. 5B, the player was presented with five shovels (i.e. attempts) to dig up a right foot. The player's first selection was the position 34*a*, revealing a "dog bone" indicia. The player's next position is position 34*b*. This position may or may not reveal a right foot. However, in the course of playing the game, at least one of the five positions selected by the player will reveal the right foot if the predetermined outcome of the game so dictates.

It is not necessary that the lottery authority devise a unique game for every individual lottery ticket sold to a player. For example, the lottery authority may maintain a library of downloadable instant win games, wherein one of the games is retrieved and downloaded for each unique ticket identification code. A plurality of the stored games may satisfy the same ticket criteria (winner or loser), but present the results to the player in a different visual manner. For example, ten different games may be stored that each satisfies the ultimate outcome in a game, but presents the outcome in a different manner, whether a loosing game or a winning game. Any one of these ten games may be downloaded to satisfy a game in accordance with a particular ticket identification code entered by the player. These games may be selected at random, sequentially, or otherwise.

It should be readily appreciated by those skilled in the art that various modifications and variations can be made to the system and method embodiments illustrated and described herein without departing from the scope and spirit of the invention.

What is claimed is:

1. A method for implementing an instant win lottery game, comprising at a point-of-sale (POS) lottery location, receiving a player's wager and selection of a particular instant win game having a particular game theme;

at the lottery location, providing to the player a lottery ticket corresponding to the selected game, the lottery ticket including a unique identification code that dictates the particular instant win game selected by the player and whether or not the lottery ticket is a winning or losing ticket;

the player accessing the lottery authority system via a wireless internet enabled mobile device and transmitting the lottery ticket identification code to the lottery authority system for verification of the lottery ticket wherein, upon verification, the instant win game is downloaded to the player's mobile device;

wherein the downloaded game provides the player with a game that reveals to the player on the mobile device whether or not the lottery ticket is a winner, with the winning status of the ticket being unaffected by the player's actual play of the game on the mobile device; and wherein the instant win game displays a simulated scratch-off play area on the player's mobile device, with the player sequentially removing a simulated scratch-off layer from a defined number of play positions within the play area that is less than all of the play positions by manipulation of the mobile device to reveal underlying indicia, and the downloaded game interactively responding the player's selected play positions by sequentially generating revealed indicia in the selected play positions to achieve the predetermined win/loss status of the lottery ticket dictated by the ticket identification code according to rules of the instant win game selected by the player regardless of the play positions selected by the player.

2. The method as in claim 1, wherein, in the case of a winning game, the player redeems the lottery ticket for the prize amount at a lottery location.

3. The method as in claim 1, wherein the mobile device is one of a mobile phone, a personal data assistant (PDA), or other type of handheld personal computing device.

4. The method as in claim 1, wherein the player is provided with an URL address to access the lottery authority system.

5. The method as in claim 1, wherein the player is provided with an SMS text message to send to a short code mobile network number to access the lottery system.

6. The method as in claim 1, wherein the lottery authority maintains a library of the downloadable instant win games, and retrieves and downloads one of the stored games that satisfies the criteria of the ticket identification code.

7. The method as in claim 1, wherein game operating software necessary for playing the games on a mobile device is downloaded to the player's mobile device.

8. The method as in claim 7, wherein the game software is downloaded by the player to a computer and transferred to the player's mobile device.

9. The method as in claim 1, further comprising providing the player with the option to present the lottery ticket at the POS terminal to reveal the status of the ticket and for prize redemption without playing the instant win game on a mobile device.

10. The method as in claim 1, wherein the mobile device sends a message to the lottery authority system upon completion of the instant win game on the mobile device.

11. The method as in claim 1, wherein the scratch-off positions are configured in an interconnected pattern, and a winning event in the game results from a defined number or pattern of indicia aligning in adjacent positions selected by the player.

12. The method as in claim 1, wherein a winning event in the game results from a defined number or type of indicia being revealed in the scratch-off positions selected by the player.

13. The method as in claim 1, wherein the identification code on the lottery ticket is covered by a scratch-off layer.

14. An instant win lottery game system, comprising:

a plurality of point-of-sale (POS) lottery terminals wherein lottery game players place a wager for an instant win lottery game ticket;

a plurality of the instant win lottery game tickets at each POS terminal, the tickets comprising indicia identifying a particular instant win game, and each ticket having a unique identification code that dictates whether or not the lottery ticket is a winning or losing ticket;

a wireless internet enabled mobile device configured to play the instant win lottery games identified on the lottery game tickets;

a library of downloadable games maintained by a lottery authority system, wherein upon receipt of the ticket identification code and verification of a valid lottery ticket, a game that satisfies the win/loss criteria of the ticket identification code is retrieved and downloaded to the mobile device for subsequent play of the instant win game;

wherein each of the instant win games is configured to simulate a scratch-off play area on the player's mobile device, with the player removing a simulated scratch-off layer from a defined number of play positions within the play area that is less than of the play positions by manipulation of the mobile device to reveal underlying indicia that indicates whether the lottery ticket is a winner; and wherein the downloaded game interactively responds to the player's selected play positions to sequentially generate revealed indicia in the selected play positions so as to achieve the predetermined win/loss status of the lottery ticket dictated by the ticket identification code according to rules of the instant win game selected by the player regardless of the play positions selected by the player.

15. The system as in claim 14, wherein winning lottery game tickets are redeemable at the POS terminal locations.

16. The system as in claim 14, wherein the mobile device is one of a mobile phone, a personal data assistant (PDA), or handheld personal computing device.

17. The system as in claim 14, wherein the library of downloadable games includes a plurality of games that satisfy the same ticket criteria but present the results of the game to the player in a different visual manner.

18. The system as in claim 14, wherein players are provided with the option to present the lottery ticket at the POS terminal to reveal the status of the ticket and for prize redemption without playing the instant win game on a mobile device.

19. The system as in claim 14, wherein the mobile device is configured to send a message to the lottery authority system upon completion of the instant win game on the mobile device.

20. The system as in claim 14, wherein the scratch-off positions are configured in an interconnected pattern grid, and a winning event in the game results from a defined number or pattern of indicia aligning in adjacent positions selected by the player.

21. The method as in claim 14, wherein a winning event in the game results from a defined number or type of discrete indicia being revealed in the scratch-off positions selected by the player.

* * * * *